US005644911A

United States Patent [19]

Huber

[11] Patent Number: 5,644,911

[45] Date of Patent: Jul. 8, 1997

[54] HYDROGEN-FUELED SEMI-CLOSED STEAM TURBINE POWER PLANT

[75] Inventor: David John Huber, Winter Park, Fla.

[73] Assignee: Westinghouse Electric Corporation, Pittsburgh, Pa.

[21] Appl. No.: 513,500

[22] Filed: Aug. 10, 1995

[51] Int. Cl.[6] ..... F02C 3/30

[52] U.S. Cl. ..... 60/39.05; 60/39.465; 60/39.52

[58] Field of Search ..... 60/39.05, 39.17, 60/39.465, 39.511, 39.52, 39.55, 736

[56] References Cited

U.S. PATENT DOCUMENTS 4,148,185 4/1979 Somers ..... 60/39.17

5,331,806 7/1994 Warkentin ..... 60/39.465

OTHER PUBLICATIONS

Van Nostrand's Scientific Encyclopedia, pp. 1332–1340 (6th ed. 1983).

*Primary Examiner*—Louis J. Casaregola
*Attorney, Agent, or Firm*—M. G. Panian

[57] ABSTRACT

A semi-closed steam turbine power system and method of operation which employs a combustor which injects and combusts hydrogen fuel and oxygen oxidant in a stoichiometric ratio so that the primary by-product of the combustion process is $H_2O$. The system also includes a recuperator, fuel preheater, fuel heater, and condenser which enable a substantial portion of the steam in the system to be recycled.

11 Claims, 2 Drawing Sheets

HYDROGEN-FUELED SEMI-CLOSED STEAM TURBINE POWER PLANT

FIELD OF THE INVENTION

The present invention relates to steam turbine plants and, in particular, closed or semi-closed steam turbine plants.

BACKGROUND OF THE INVENTION

Turbine systems employ a pressurized gas to provide mechanical energy to blades of a rotor. As the pressurized gas is expanded in a turbine, the rotor generates mechanical energy in the form of torque on a shaft of the rotor. Common gases used in turbine systems include atmospheric air (mainly nitrogen) and steam ($H_2O$).

An example of a prior art open, atmospheric air, combustion turbine 120 is shown in FIG. 1. The turbine 120 shown in FIG. 1 has an eight stage axial compressor 124 and 126, combustor 128, and three stage axial flow turbine component 134. In this turbine 120, atmospheric air is drawn in an air inlet 122 and compressed by the stator blades 124 and compressor blades 126. The air (or gas) generated by the compressor blades 126 has increased pressure and temperature and lower volume as compared to the gas which entered the compressor. This gas is further heated or super heated in the combustor 128 where fuel is added at the fuel inlet 132. The gas generated by the combustor 128 has increased volume and temperature as compared to the gas which entered the combustor.

The high pressure, high temperature gas generated by the combustor 128 is passed along blades of the turbine component 134 causing rotation of the shaft 138 of the turbine and the generation of energy. Then the gas passes into the turbine exhaust 136. The gas which exits past the blades of the turbine component 134 has lower pressure and temperature and increased volume as compared to the gas which exited the combustor 128. The exhaust gas, however, still has increased temperature and volume as compared to the atmospheric air which initially entered the air inlet 122.

Semi-closed and closed systems have been developed to exploit the energy potential of the gas produced in the exhaust of open combustion turbine systems. See, for example, Van Nostrand's Scientific Encyclopedia 1332–40 (6th ed. 1983), which is hereby incorporated by reference. The reference discloses that in a semi-closed or closed atmospheric air system, energy may be extracted from the exhaust air by a regenerator.

In addition, the reference discloses that in such systems, if a portion of the exhaust air is to be recycled it must be further processed, by a precooler, for example, to change the pressure level, volume, and temperature of the exhaust air to be similar to the pressure level, volume, and temperature of air which enters the closed system at the compressor stage. The reference does not disclose a system or method for processing exhaust steam to change its pressure level, volume, and temperature to be similar to the pressure level, volume, and temperature of steam which enters the closed system at the compressor stage of a system.

In turbine systems, the choice of fuel used in the combustor is important and varies as a function of the type of gas used in the system, i.e., atmospheric air or steam ($H_2O$), for example. In atmospheric air systems, natural, refinery, and blast furnace gas are commonly used. In these systems, it is important that the fuel does not form ash which may deposit on the blades or dust which may erode the blades of a turbine and interfere with the long term operation of the turbine.

In semi-closed or closed systems, the choice of fuel is critical because a portion of the gas or air is recycled throughout the turbine system. If the fuel generates ash or dust or other by-products in a semi-closed or closed system, a portion of the by-products will be cycled throughout the entire turbine system with the recycled air. In a semi-closed or closed steam turbine system, ash or dust may adhere to water particles and be transmitted throughout the turbine system. As a consequence, a need exists for steam combustion turbine system which produces little or no byproduct, such as ash or dust, for example, during the combustion process.

SUMMARY OF THE INVENTION

An object of the present invention is to provide a semi-closed steam turbine power plant and method for its operation which produces little or no byproduct during the combustion process. In an exemplary embodiment, the power system includes a steam compressor, combustor, and steam turbine. The combustor injects and combusts a stoichiometric ratio of hydrogen fuel and oxygen oxidant in high pressure steam generated by the steam compressor to generate superheated steam, the injection and combustion of hydrogen fuel and oxygen oxidant producing little byproduct other than $H_2O$. A portion of the high pressure steam generated by the steam compressor may be received by and used to cool the steam turbine.

In another embodiment, the power system also includes a condenser. The condenser receives exhaust steam and generates saturated steam and condensate from exhaust steam. The compressor also includes water droplet injectors, where the water droplet injectors receive condensate generated by the condenser and inject droplets into the saturated steam during the compression of the steam by the compressor. The injection of droplets into the saturated steam during its compression reduces the temperature of the high pressure steam generated by the compressor by continuously cooling the compressor.

This embodiment may further include a recuperator. The recuperator receives high pressure steam from the compressor and exhaust steam from the steam turbine, extracts heat from the exhaust steam, generates a reduced temperature, exhaust steam from the exhaust steam, and applies the extracted heat to the high pressure steam to generate an elevated temperature, high pressure steam. The combustor receives the elevated temperature, high pressure steam generated by the recuperator instead of the high pressure steam generated by the compressor.

In an additional enhancement of this embodiment, the power plant also includes a fuel preheater and a fuel heater. The fuel preheater receives hydrogen fuel and oxygen oxidant and reduced temperature, exhaust steam from the recuperator, extracts heat from the reduced temperature, exhaust steam, and applies the extracted heat to the hydrogen fuel and oxygen oxidant to generate preheated hydrogen fuel and preheated oxygen oxidant.

The fuel heater receives preheated hydrogen fuel and preheated oxygen oxidant generated by the fuel preheater and exhaust steam generated by steam turbine, extracts heat from the exhaust steam, and applies the extracted heat to the preheated hydrogen fuel and preheated oxygen oxidant to generate heated hydrogen fuel and heated oxygen oxidant. The combustor injects and combusts the heated hydrogen fuel and the heated oxygen oxidant generated by the fuel heater.

Further, the amount of exhaust steam received by the fuel heater from the steam turbine is similar in mass flow to the amount of steam generated by the injection and combustion of the heated hydrogen fuel and heated oxygen oxidant in the combustor. In addition, after the fuel heater extracts heat from the exhaust steam, the steam is removed from the turbine system through the fuel heater.

DETAILED DESCRIPTION OF THE PREFERRED EMBODIMENTS

Figure 1:
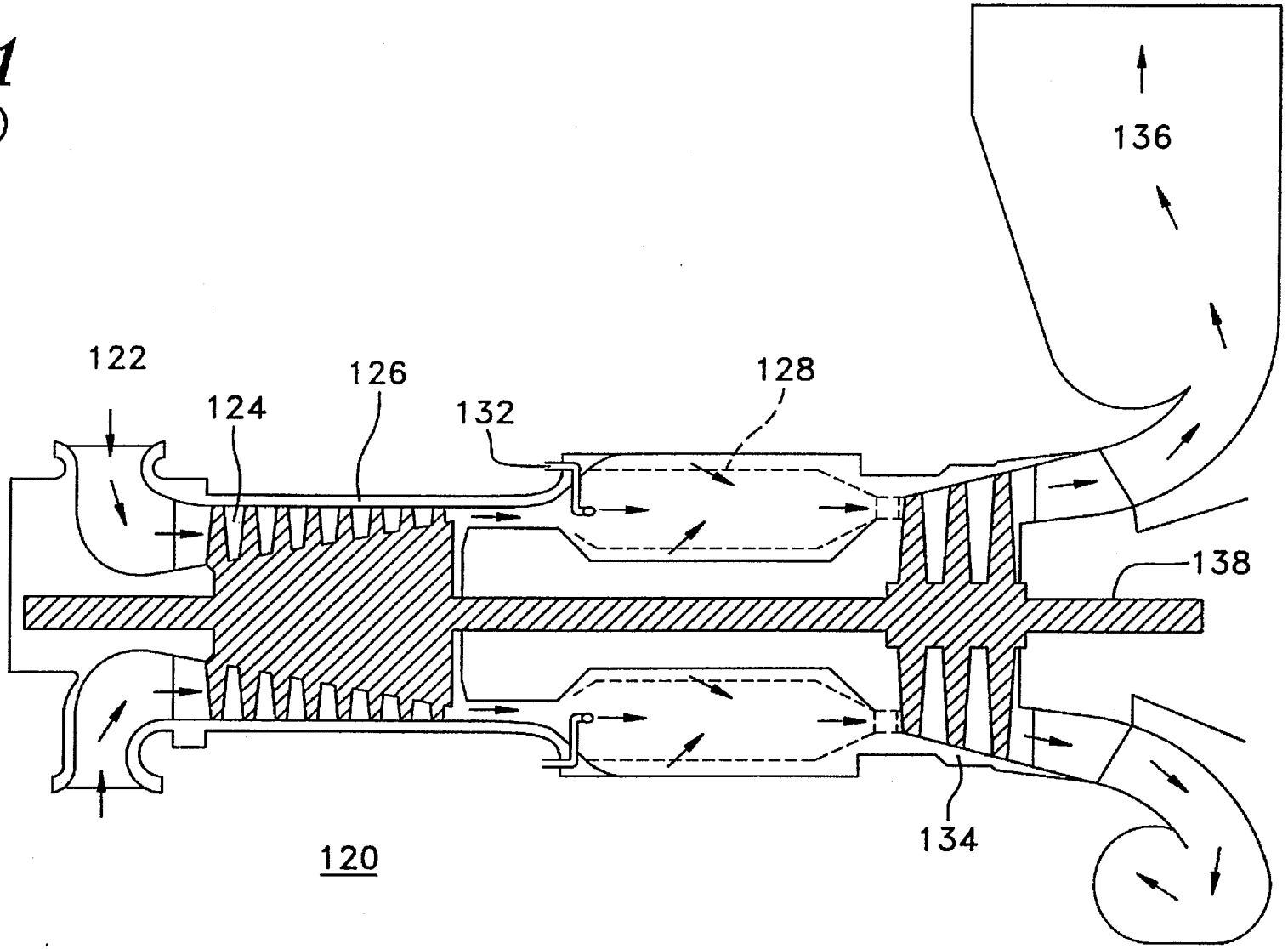
FIG. 1 (PRIOR ART)
FIG. 1 (Prior Art) is a cross-sectional view of an atmospheric air combustion turbine system.
Figure 2:
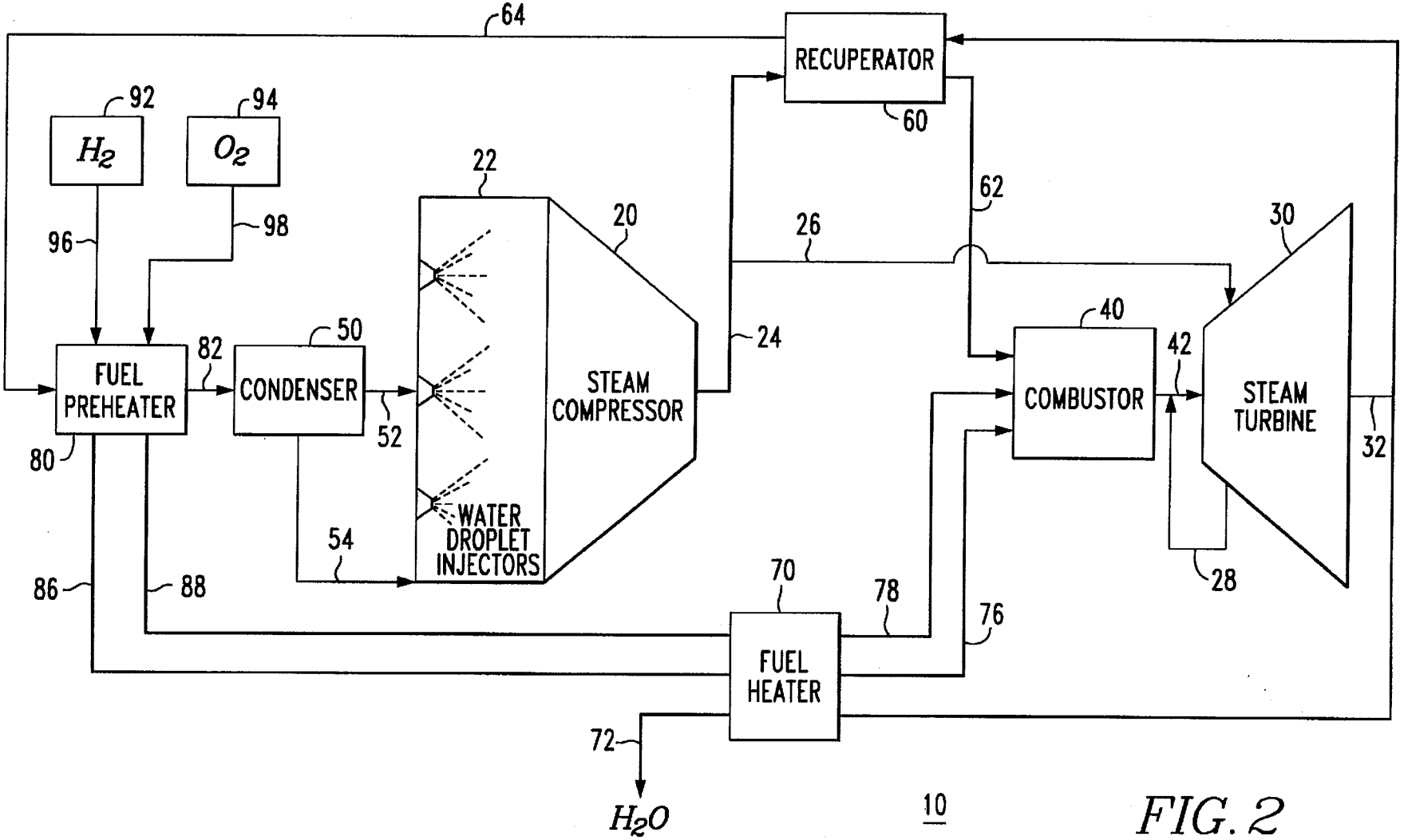
FIG. 2 is a diagram of exemplary semi-closed steam combustion turbine system according to the present invention.

FIG. 2 illustrates a diagram of an exemplary semi-closed steam turbine power plant or system 10 of the present invention. The system 10 includes a steam compressor 20, steam turbine 30, combustor 40, condenser 50, recuperator 60, fuel heater 70, fuel preheater 80, hydrogen source 92, and oxygen source 94. These components form a semi-closed system where only excess water 72 is drained from fuel heater 70 as described in more detail below.

The steam compressor 20 receives saturated steam 52 and condensate 54 from the condenser 50 and generates high pressure steam 24. The condenser 50 (described in more detail below) generates the saturated steam 52 having temperature T1, pressure level P1, and volume V1 and the condensate 54. The condensate 54 is used by water droplet injectors 22 which are included in the steam compressor 20 of the present invention. The water droplet injectors 22 supply water droplets from the condensate 54 at the inlet of the steam compressor 20 into the saturated steam 52. The water droplets lower the temperature T1 of the saturated steam as the water droplets evaporate into steam during the compressor process.

The steam compressor 20 compresses the saturated steam 52 producing high pressure steam 24 having a temperature T2 (T2>T1), pressure level P2 (P2>P1) and volume V2 (V2<V1). The water droplet injection process, described above, prevents the temperature T2 of the steam 24 from climbing as high as it ordinarily would in the steam compressor 20. As a consequence, in a preferred embodiment of the invention, a portion 26 of the high pressure steam 24 is also supplied directly to the steam turbine 30. As described in more detail below, the high pressure steam is used to help keep the steam turbine 30 cool during operation. The water droplet injection process, thus, reduces the required power input for the compressor 20.

The recuperator 60 receives the compressed steam 24 generated by the compressor 20 and exhaust steam 32 generated by the steam turbine 30 and generates increased temperature, high pressure steam 62 and reduced temperature, exhaust steam 64. As described in more detail below, the steam turbine 30 generates exhaust steam 32 which is directed to the recuperator 60 and the fuel heater 70. The recuperator 60 extracts heat from the exhaust steam 32 and generates reduced temperature exhaust steam 64 from the reduced heat exhaust steam 32. The recuperator 60 applies the extracted heat to the high pressure steam 24 to generate higher temperature, high pressure steam 62 having temperature T3 (T3>T2), pressure level~P2, and volume V3 (V3>V2).

The combustor 40 receives the high pressure steam 62 generated by the recuperator 60 and heated hydrogen fuel 76 and heated oxygen oxidant 78 from the fuel heater 70 and generates superheated, high pressure steam 42. As described in more detail below, the fuel heater 70 generates or supplies heated hydrogen fuel 76 and heated oxygen oxidant 78. The combustor 40 injects and combusts the heated hydrogen fuel 76 and the heated oxygen oxidant 78 at a stoichiometric ratio of hydrogen to oxygen. The combustion of the combination of fuels substantially increases the temperature of the steam 62, generating superheated, high pressure steam 42 having a pressure level~P2, temperature T4 (T4>T3), and volume (V4>V3). The primary byproduct of the combustion of hydrogen fuel 76 and oxygen oxidant 78 provided at a stoichiometric ratio is $H_2O$. As a consequence, the combustor 40 of the present invention produces little, if any, ash, dust, or other byproduct that is not absorbed into the operating gas of the turbine system, in this case, steam.

The steam turbine 30 receives the superheated, high pressure steam 42 generated by the combustor 40 and generates mechanical energy (not shown) and exhaust steam 32. Blades (not shown) of the steam turbine 30 absorb energy from the superheated steam 42 as the steam passes over the blades. The steam 42 expands during this process increasing its volume, reducing its pressure level and lowering its temperature. The result of the expansion process is mechanical energy (absorption of energy by blades causing the rotation of a shaft upon which the blades are attached) and exhaust steam 32 having a pressure P3 (P1<P3<P2), temperature T5 (T1<T5<T4), and volume V5 (V5>V4). As noted above, a portion of the exhaust steam 32 is directed to both the recuperator 60 and fuel heater 70.

In the preferred embodiment of the invention, a portion 26 of the high pressure steam 24 generated by the compressor 20 is also directed to the steam turbine 30 to help cool the steam turbine 30. The high pressure steam 26 has a significantly lower temperature than the superheated steam 62. The high pressure steam 26 is directed along an outer portion of the steam turbine 30 to reduce the operating temperature of the steam turbine 30. The temperature of this steam 26 as a consequence will be elevated. The elevated temperature steam 28 is added to or combined with the exhaust steam 42 at the stage of the expansion process in the preferred embodiment of the invention.

As described above, the combustor 40 injects and combusts heated hydrogen fuel 76 and heated oxygen oxidant 78. Hydrogen source 92 supplies hydrogen fuel 96 and oxygen source 94 supplies oxygen oxidant 98. Fuel preheater 80 receives the reduced temperature, exhaust steam 64 from the recuperator 60, hydrogen fuel 96 from the hydrogen source 92, and oxygen oxidant 98 from the oxygen source 94 and generates preheated hydrogen fuel 86, preheated oxygen oxidant 88, and further reduced temperature exhaust steam 82. Fuel preheater 80 extracts heat from the reduced temperature, exhaust steam 64 to generate further reduced temperature exhaust steam 82. The extracted heat is used to generate the preheated hydrogen fuel 86 and the preheated oxygen oxidant 88 from the hydrogen fuel 96 and the oxygen oxidant 98.

The fuel heater 70 receives the preheated hydrogen fuel 86 and the preheated oxygen oxidant 88 generated by the fuel preheater and exhaust steam 32 generated by the steam turbine 30 and generates heated hydrogen fuel 76 and heated oxygen oxidant 78. Similar to the fuel preheater 80, the fuel heater 70 extracts heat from a steam source, in this case, exhaust steam 32. The exhaust steam 32 has a greater temperature, however, than the reduced temperature, exhaust steam 64 supplied to the fuel preheater 80. As a consequence, the fuel preheater 70 extracts a higher level of heat from its steam source and in turn provides a greater level of heat to the hydrogen fuel 76 and the oxygen oxidant 78.

In the preferred embodiment of the invention, after heat has been extracted from the exhaust steam 32, the fuel heater generates water ($H_2O$) 72 which is removed from the system. The mass flow rate of water removed from the system by the fuel heater is similar to mass flow rate of water introduced into the system by the combustion process of the present invention. Thus, the amount or level of exhaust steam 32 directed to the fuel heater by the steam turbine 30 is similar to the level of steam generated by the injection of heated hydrogen fuel 76 and the heated oxygen oxidant 78 into the combustor 40. This prevents too much or too little steam from being present in the turbine system at anyone time. Other than the removal of water 72 in the fuel heater 70, the steam turbine system 10 of the present invention is a closed system. As a consequence, the system of the present invention has an ecological advantage over systems that use different types of gas in the system or different fuels for combustion because the system of the present invention's only byproduct is pure water ($H_2O$).

The last significant element of the present invention is the condenser 50. The condenser 50 receives the further reduced temperature, exhaust steam 82 from the fuel preheater and generates the saturated steam 52 and the condensate 54. As noted above, the exhaust steam 82 has a substantially reduced temperature as compared to the exhaust steam 32 due to extraction of heat from the steam by the recuperator 60 and the fuel preheater 80. The condenser 50 further cools the temperature of the exhaust steam 82 to saturation temperature T1 to generate the saturated steam 52 having temperature T1, pressure level P1, and volume V1. The condenser 50 further cools a portion of the exhaust steam 82 until enough condensate 54 is generated to supply the water droplet injectors 22 at the inlet of the compressor 20.

Thus, due to the use of the recuperator 60, fuel preheater 80, and condenser 50, the turbine power plant or system 10 of the present invention is able to fully recycle a substantial portion of steam. Only a small portion of steam, equivalent to the level of steam generated by the combustion process of injecting and combusting the heated hydrogen fuel 76 and the heated oxygen oxidant 78 is removed from the system by the fuel heater 70.

Although the invention has been described in terms of an exemplary embodiment, the spirit and scope of the appended claims are unlimited by any details not expressly stated in the claims.

What is claimed is:

1. A steam turbine power system, comprising:

a steam compressor receiving steam having a first pressure level and generating high pressure steam having a scond pressure level greater than the first pressure level;

a combustor receiving high pressure steam from the steam compressor, the high pressure steam having a first temperature, the combustor injecting and combusting a stoichiometric ratio of hydrogen fuel and oxygen oxidant in the high pressure steam to generate superheated steam having a second temperature greater than the first temperature, the injection and combustion of hydrogen fuel and oxygen oxidant producing little byproduct other than $H_2O$; and a steam turbine receiving superheated steam generated by the combustor and generating mechanical energy from the superheated steam, wherein a portion of the high pressure steam generated by the steam compressor is received by and used to cool the steam turbine.

2. A semi-closed steam turbine power system, comprising:

a condenser receiving exhaust steam and generating saturated steam from a first portion of the exhaust steam and condensate from a second portion of the exhaust steam;

a steam compressor receiving saturated steam from the condenser, the saturated steam having a first pressure level and generating high pressure steam having a second pressure level greater than the first pressure level, the compressor including water droplet injectors which receive the condensate generated by the condenser and inject droplets into the saturated steam during the compression of the steam by the compressor thereby reducing the temperature of the high pressure steam generated by the compressor;

a combustor receiving high pressure steam generated by the steam compressor, the high pressure steam having a first temperature, the combustor injecting and combusting a stoichiometric ratio of hydrogen fuel and oxygen oxidant in the high pressure steam to generate superheated, high pressure steam having a second temperature greater than the first temperature, the injection and combustion of hydrogen fuel and oxygen oxidant producing little byproduct other than $H_2O$; and a steam turbine receiving superheated steam generated by the combustor and generating mechanical energy from the superheated steam, the steam turbine generating the exhaust steam from the superheated steam, the exhaust steam having a third temperature less than the second temperature and greater than the first temperature, wherein a portion of the high pressure steam generated by the steam compressor is received by and used to cool the steam turbine.

3. A semi-closed steam turbine power system according to claim 2, further including a recuperator, the recuperator receiving high pressure steam from the compressor and exhaust steam from the steam turbine, extracting heat from the exhaust steam and generating a reduced temperature, exhaust steam, and applying the extracted heat to the high pressure steam to generate an elevated temperature, high pressure steam having a fourth temperature greater than the first temperature and less than the second temperature, wherein the condenser receives the exhaust steam from the reduced temperature, exhaust steam generated by the recuperator, and wherein the combustor receives the high pressure steam from the elevated temperature, high pressure steam generated by the recuperator.

4. A semi-closed steam turbine power system according to claim 2, further including a fuel preheater, the fuel preheater receiving hydrogen fuel and oxygen oxidant and reduced temperature, exhaust steam from the recuperator, extracting heat from the reduced temperature, exhaust steam and generating a further reduced temperature, exhaust steam, and applying the extracted heat to the hydrogen fuel and oxygen oxidant to generate preheated hydrogen fuel and preheated oxygen oxidant, wherein the condenser receives the exhaust steam from the further reduced temperature, exhaust steam generated by the fuel preheater, and wherein the combustor receives the hydrogen fuel and oxygen oxidant from preheated hydrogen fuel and preheated oxygen oxidant generated by the fuel preheater.

5. A semi-closed steam turbine power system according to claim 4, further including a fuel heater, the fuel heater receiving preheated hydrogen fuel and preheated oxygen oxidant generated by the fuel preheater and exhaust steam generated by steam turbine, extracting heat from the exhaust steam and applying the extracted heat to the preheated hydrogen fuel and preheated oxygen oxidant to generate heated hydrogen fuel and heated oxygen oxidant and wherein the combustor receives the hydrogen fuel and oxygen oxidant from the heated hydrogen fuel and the heated oxygen oxidant generated by the fuel heater.

6. A semi-closed steam turbine power system according to claim 5, wherein the amount of exhaust steam received by the fuel heater from the steam turbine is similar to the amount of steam generated by the injection and combustion of the heated hydrogen fuel and heated oxygen oxidant in the combustor and wherein after the fuel heater extracts heat from the exhaust steam, the steam is removed from the turbine system through the fuel heater.

7. A semi-closed steam turbine power system, comprising:

a condenser for generating saturated steam and condensate;

a steam compressor for receiving the saturated steam and condensate generated by the condenser, the saturated steam having a first pressure level and generating high pressure steam having a second pressure level greater than the first pressure level, the steam compressor including water droplet injectors which receive the condensate generated by the condenser and inject droplets into the saturated steam during the compression of the steam by the compressor thereby reducing the temperature of the high pressure steam generated by the compressor;

a recuperator receiving high pressure steam from the compressor and a first portion of exhaust steam, extracting heat from the first portion of exhaust steam and generating a reduced temperature, exhaust steam, and applying the extracted heat to the high pressure steam to generate an elevated temperature, high pressure steam;

a fuel preheater receiving hydrogen fuel and oxygen oxidant and the reduced temperature, exhaust steam from the recuperator, extracting heat from the reduced temperature, exhaust steam and generating a further reduced temperature, exhaust steam, and applying the extracted heat to the hydrogen fuel and oxygen oxidant to generate preheated hydrogen fuel and preheated oxygen oxidant;

a fuel heater receiving the preheated hydrogen fuel and the preheated oxygen oxidant generated by the fuel preheater and a second portion of exhaust steam, extracting heat from the second portion of exhaust steam and applying the extracted heat to the preheated hydrogen fuel and the preheated oxygen oxidant to generate heated hydrogen fuel and heated oxygen oxidant;

a combustor receiving the heated hydrogen fuel and the heated oxygen oxidant generated by the fuel heater and the elevated temperature, high pressure steam generated by the recuperator, the elevated temperature, high pressure steam having a first temperature, the combustor injecting and combusting a stoichiometric ratio of the heated hydrogen fuel and the heated oxygen oxidant in the elevated temperature, high pressure steam to generate superheated, high pressure steam having a second temperature greater than the first temperature, the injection and combustion of the heated hydrogen fuel and the heated oxygen oxidant producing little byproduct other than $H_2O$;

a steam turbine receiving the superheated, high pressure steam generated by the combustor and generating mechanical energy from the superheated, high pressure steam, the steam turbine generating the first and second portions of exhaust steam from the superheated, high pressure steam, the first and second portions of exhaust steam having a third temperature less than the second temperature and greater than the first temperature, the steam turbine also receiving a portion of the high pressure steam generated by the steam compressor and using the portion of the high pressure steam to cool the steam turbine; and the condenser receiving the further reduced temperature, exhaust steam from the fuel preheater and generating the saturated steam and condensate, wherein the amount of the second portion of exhaust steam received by the fuel heater from the steam turbine is similar to the amount of steam generated by the injection and combustion of the heated hydrogen fuel and the heated oxygen oxidant in the combustor and wherein after the fuel heater extracts heat from the second portion of the exhaust steam, the second portion of the exhaust steam is removed from the turbine system through the fuel heater.

8. A method of operating a semi-closed steam turbine power system, comprising the steps of:

a) generating saturated steam from exhaust steam by condensing the exhaust steam;

b) generating high pressure steam having a second pressure level from saturated steam by compressing the saturated steam, the saturated steam having a first pressure level lower than the second pressure level;

c) generating a condensate from a portion of the exhaust steam;

d) injecting droplets formed from the condensate into the saturated steam during the compression of the steam, thereby reducing the temperature of the high pressure steam;

e) generating superheated steam having a second temperature by injecting and combusting a stoichiometric ratio of hydrogen fuel and oxygen oxidant into the high pressure steam, the high pressure steam having a first temperature less than the second temperature, the injection and combustion of hydrogen fuel and oxygen oxidant producing little byproduct other than $H_2O$;

f) generating mechanical energy and the exhaust steam from the superheated steam by means of a steam turbine, the exhaust steam having a third temperature less than the second temperature and greater than the first temperature; and g) cooling the steam turbine with the high pressure steam.

9. A method of operating a semi-closed steam turbine power system according to claim 1, further comprising the steps of:

extracting heat from the exhaust steam and generating a reduced temperature, exhaust steam; and applying the extracted heat to the high pressure steam to generate an elevated temperature, high pressure steam having a fourth temperature greater than the first temperature and less than the second temperature, wherein step a) comprises generating saturated steam from the reduced temperature, exhaust steam by condensing the exhaust steam and step c) comprises generating superheated steam having a second temperature by injecting and combusting a stoichiometric ratio of hydrogen fuel and oxygen oxidant into the elevated temperature, high pressure steam, the injection and combustion of hydrogen fuel and oxygen oxidant producing little byproduct other than $H_2O$.

10. A method of operating a semi-closed steam turbine power system according to claim 9, further comprising the steps of:

extracting heat from the reduced temperature, exhaust steam and generating a further reduced temperature, exhaust steam from the reduced temperature, exhaust steam after the heat is extracted; and applying the extracted heat to hydrogen fuel and oxygen oxidant to generate preheated hydrogen fuel and preheated oxygen oxidant, wherein step a) comprises generating saturated steam from the further reduced temperature, exhaust steam by condensing the exhaust steam and step c) comprises generating superheated steam having a second temperature by injecting and combusting a stoichiometric ratio of the preheated hydrogen fuel and the preheated oxygen oxidant into the elevated temperature, high pressure steam, the injection and combustion of hydrogen fuel and oxygen oxidant producing little byproduct other than $H_2O$.

11. A method of operating a semi-closed steam turbine power system according to claim 10, further comprising the step of applying the extracted heat to the preheated hydrogen fuel and preheated oxygen oxidant to generate heated hydrogen fuel and heated oxygen oxidant, wherein step c) comprises generating superheated steam having a second temperature by injecting and combusting a stoichiometric ratio of the heated hydrogen fuel and the heated oxygen oxidant into the elevated temperature, high pressure steam, the injection and combustion of hydrogen fuel and oxygen oxidant producing little byproduct other than $H_2O$.

* * * * *